US009409734B2

(12) United States Patent
Tahara et al.

(10) Patent No.: US 9,409,734 B2
(45) Date of Patent: Aug. 9, 2016

(54) MANUAL PAPER FEEDER THAT ENSURES STABLE PAPER FEEDING OPERATION AND IMAGE FORMING APPARATUS INCLUDING THE SAME

(71) Applicant: Kyocera Document Solutions Inc., Osaka (JP)

(72) Inventors: Mitsuhiro Tahara, Osaka (JP); Tomoya Hotani, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 14/834,741

(22) Filed: Aug. 25, 2015

(65) Prior Publication Data

US 2016/0052735 A1 Feb. 25, 2016

(30) Foreign Application Priority Data

Aug. 25, 2014 (JP) ..... 2014-170302

(51) Int. Cl.

| | |
|---|---|
| ***B65H 3/44*** | (2006.01) |
| ***B65H 5/06*** | (2006.01) |
| ***B65H 1/04*** | (2006.01) |
| ***B65H 1/28*** | (2006.01) |
| ***B65H 1/26*** | (2006.01) |
| ***B65H 1/08*** | (2006.01) |

(52) U.S. Cl.

CPC .. *B65H 3/44* (2013.01); *B65H 1/04* (2013.01); *B65H 1/08* (2013.01); *B65H 1/266* (2013.01); *B65H 1/28* (2013.01); *B65H 5/062* (2013.01); *B65H 2405/11164* (2013.01); *B65H 2405/111643* (2013.01); *B65H 2405/111646* (2013.01); *B65H 2405/324* (2013.01); *B65H 2407/21* (2013.01)

(58) Field of Classification Search

CPC ..... B65H 2405/11164; B65H 2405/111643; B65H 2405/111646; B65H 2407/21

USPC ..... 271/9.07, 9.08, 9.09, 9.11, 9.13, 171

See application file for complete search history.

(56) References Cited

U.S. PATENT DOCUMENTS

| | | | | |
|---|---|---|---|---|
| 8,857,808 | B2 * | 10/2014 | Matsumoto | B65H 1/04 271/127 |
| 2009/0267283 | A1 * | 10/2009 | Mizuguchi | B65H 1/04 271/3.14 |
| 2013/0106043 | A1 * | 5/2013 | Murakami | B65H 1/04 271/9.01 |

FOREIGN PATENT DOCUMENTS

JP 2001-328752 A 11/2001

* cited by examiner

*Primary Examiner* — Howard Sanders
(74) *Attorney, Agent, or Firm* — James Judge

(57) ABSTRACT

A manual paper feeder includes is for installation at a side surface of a main body of an image forming apparatus. When the first auxiliary tray is located at an extension position in a state where the second auxiliary tray is housed downwards, an abutment between an upstream side end edge of the side surface cover and an inferior surface of the second auxiliary tray supports the first auxiliary tray at a first angle. When the second auxiliary tray is extracted from the first auxiliary tray at the extension position, an abutment between the upstream side end edge of the side surface cover and the inferior surface of the first auxiliary tray supports the first auxiliary tray at a second angle. The second angle is smaller than the first angle.

3 Claims, 10 Drawing Sheets

MANUAL PAPER FEEDER THAT ENSURES STABLE PAPER FEEDING OPERATION AND IMAGE FORMING APPARATUS INCLUDING THE SAME

INCORPORATION BY REFERENCE

This application is based upon, and claims the benefit of priority from, corresponding Japanese Patent Application No. 2014-170302 filed in the Japan Patent Office on Aug. 25, 2014, the entire contents of which are incorporated herein by reference.

BACKGROUND

Unless otherwise indicated herein, the description in this section is not prior art to the claims in this application and is not admitted to be prior art by inclusion in this section.

Commonly, an image forming apparatus such as a copier, a printer, and a facsimile device includes a sheet feed cassette, which stores sheet-shaped recording mediums such as a paper sheet, and is attachable and removable. The image forming apparatus is constituted such that paper sheets are supplied from the sheet feed cassette and the image forming apparatus forms an image. However, when using a paper sheet with a different size from a paper sheet stored in the sheet feed cassette, in each case, a user needs to store a desired paper sheet in the sheet feed cassette again, thus causing a complicated operation. Thus, there is known an image forming apparatus that includes a manual paper feeder (bypass unit) to which a sheet-shaped recording medium can be supplied without via the sheet feed cassette.

A manual paper feeder that employs one technique includes a bypass tray on which paper sheets are to be placed, a sheet feed roller that sends the most upper paper sheet on the bypass tray, and a press member. The press member includes a paper sheet width guide, which is located on the bypass tray and restricts positional slippage in a width direction orthogonal to a paper feeding direction of a paper sheet, thus pressing a top surface of a paper sheet placed on the bypass tray in an upstream side in a paper feeding direction of the sheet feed roller.

The manual paper feeder includes a press member at an upstream side of a paper feeding direction of a sheet feed roller. This reduces a lift of a paper sheet center portion due to a press of the sheet feed roller, and prevents the skew and lateral slippage of a paper sheet.

SUMMARY

A manual paper feeder according to one aspect of the disclosure is installed at a side surface of a main body of an image forming apparatus. The manual paper feeder includes a side surface cover, a sheet loading tray, a separation conveying unit, and an elevating plate. The side surface cover is turnably supported by the side surface of the main body and selectively located at one of an open position and a close position. The open position is where the side surface cover is opened by a predetermined angle from the side surface of the main body. The close position is where the side surface cover is housed in a housing unit formed at the side surface of the main body. The sheet loading tray is located at a top surface of the side surface cover and capable of loading a sheet when the side surface cover is located at the open position. The separation conveying unit includes a feed member and a separation member. The feed member is located at a downstream side of the sheet loading tray in a feed direction for sending out a sheet to a feed direction. The separation member is located facing the feed member. The separation conveying unit separately conveys only one paper sheet at a most upper side of sheets loaded on the sheet loading tray. The elevating plate is located at the downstream side of the sheet loading tray in the feed direction so as to cause a downstream portion of the sheet to abut on the feed member. A first auxiliary tray and a second auxiliary tray are slidably disposed so as to overlap one another in a sheet loading direction at an upstream side of the seat loading tray in the feed direction of sheet. The first auxiliary tray is selectively located at a house position where the first auxiliary tray is housed to be overlapped between the side surface cover and the sheet loading tray or an extension position where the first auxiliary tray is extracted from the house position so as to extend a loading surface of the sheet loading tray. The second auxiliary tray extends the first auxiliary tray. When the first auxiliary tray is located at the extension position in a state where the second auxiliary tray is housed downwards, an abutment between an upstream side end edge of the side surface cover and an inferior surface of the second auxiliary tray supports the first auxiliary tray at a first angle. When the second auxiliary tray is extracted from the first auxiliary tray at the extension position, an abutment between the upstream side end edge of the side surface cover and the inferior surface of the first auxiliary tray supports the first auxiliary tray at a second angle. The second angle is smaller than the first angle.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
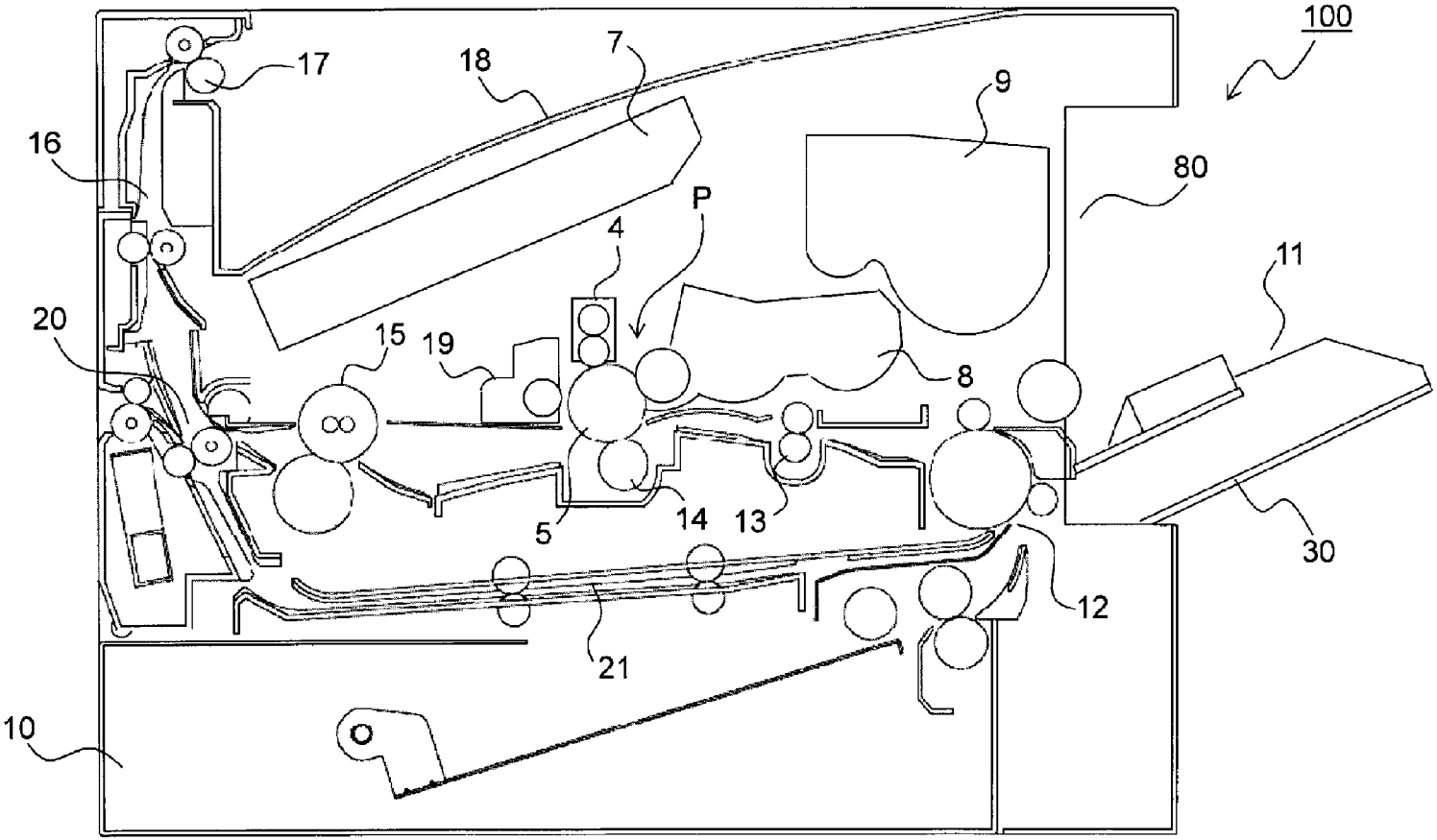
FIG. 1 illustrates a side surface of an internal structure of an image forming apparatus that includes a manual paper feeder according to embodiments of the disclosure in a cross-sectional view.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

The following describes embodiments of the disclosure with reference to the drawings. FIG. 1 illustrates a side surface in a cross-sectional view of an internal structure of an image forming apparatus 100 that includes a manual paper feeder 11 of the disclosure. In the image forming apparatus (for example, a monochrome printer) 100, an image forming unit P is located. The image forming unit P forms a monochrome image through respective processes of charge, exposure, develop, and transfer. In the image forming unit P, along a rotation direction of a photoreceptor drum 5 (clockwise direction in FIG. 1), a charging unit 4, an exposure unit (for example, a laser scanning unit) 7, a developer unit 8, a transfer roller 14, a cleaning device 19, and a static eliminator (not illustrated) are located.

An image forming operation is performed as follows. The charging unit 4 evenly charges the photoreceptor drum 5, which rotates in clockwise direction. A laser beam, which is based on document image data and from the exposure unit 7, forms an electrostatic latent image on the photoreceptor drum 5. The developer unit 8 attaches developer (hereinafter referred to as toner) to the electrostatic latent image to form a toner image.

Toner is supplied from a toner container 9 to the developer unit 8. Image data is transmitted from a personal computer (not illustrated) or similar apparatus. The static eliminator (not illustrated), which removes residual charge on the surface of the photoreceptor drum 5, is located at a downstream of the cleaning device 19.

As described above, toward the photoreceptor drum 5 where a toner image is formed, a paper sheet is conveyed from a sheet feed cassette 10 or the manual paper feeder 11 via a paper sheet conveyance passage 12 and a registration roller pair 13. The transfer roller 14 (image transfer unit) transfers the toner image formed on the surface of the photoreceptor drum 5 on the paper sheet. The paper sheet, on which the toner image is transferred, is separated from the photoreceptor drum 5 and conveyed to a fixing unit 15, and then the toner image is fixed on the paper sheet. The paper sheet having passed through the fixing unit 15 is conveyed by a paper sheet conveyance passage 16 to an upper portion of the image forming apparatus 100. When the image is formed on only one surface of the paper sheet (for single-sided printing), a discharge roller pair 17 discharges the paper sheet to a discharge tray 18.

On the other hand, when the images are formed on both surfaces of the paper sheet (for duplex printing), after a rear end of the paper sheet passes through a curving portion 20 of the paper sheet conveyance passage 16, a conveyance direction of the paper sheet is reversed. This sends the paper sheet into an inverting conveyance path 21 branching from the curving portion 20, and the paper sheet is conveyed again to the registration roller pair 13 in a state where a surface of the image is inverted. Then, the transfer roller 14 transfers a next toner image formed on the photoreceptor drum 5 on a surface of the paper sheet where any image is not formed. The paper sheet, on which the toner image has been transferred, is conveyed to the fixing unit 15 to fix the toner image and discharged by the discharge roller pair 17 to the discharge tray 18.

Figure 2:
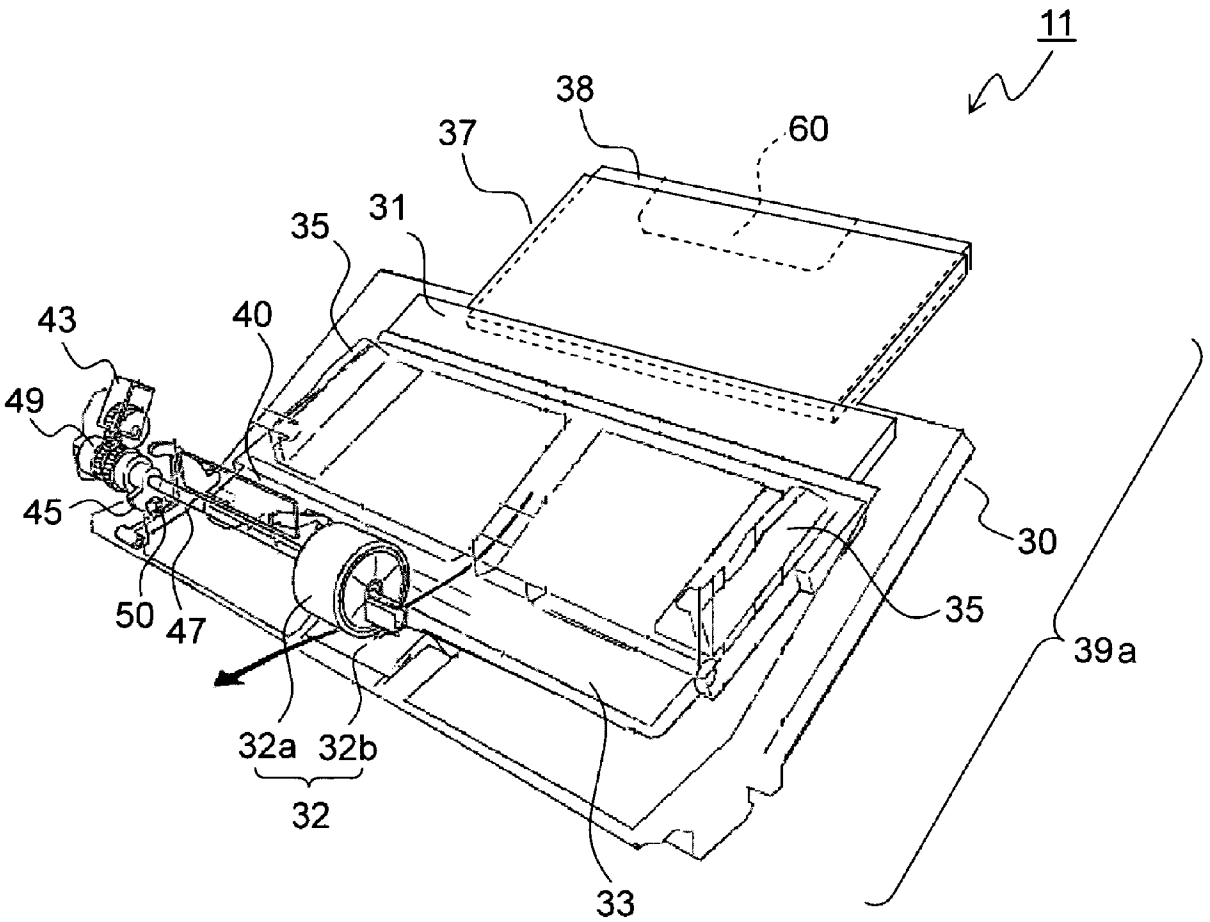
FIG. 2 obliquely illustrates an inside state where a manual paper feeder according to a first embodiment of the disclosure is opened at a predetermined angle.
Figure 3:
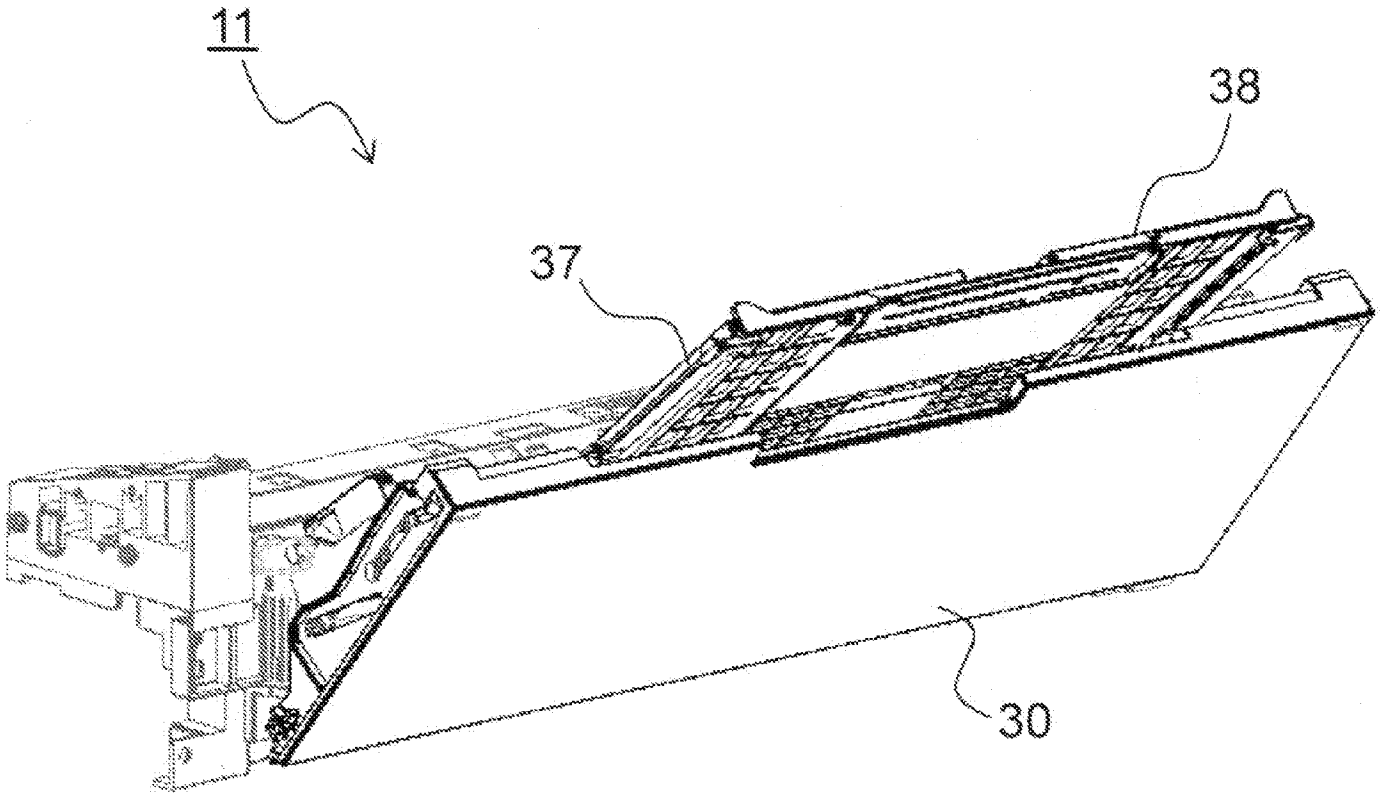
FIG. 3 obliquely illustrates an outside state where the manual paper feeder according to the first embodiment is opened at the predetermined angle.

FIG. 2 and FIG. 3 obliquely illustrate an inside and an outside states where the manual paper feeder 11 according to the first embodiment of the disclosure is opened at a predetermined angle, respectively. The manual paper feeder 11 is constituted by a paper sheet stack unit 39*a*, a paper feeding unit, and a paper sheet detecting unit and similar units. The paper sheet stack unit 39*a* includes, for example, a side surface cover 30, a paper sheet tray 31, width adjustment guides 35, a first auxiliary tray 37, and a second auxiliary tray 38. The paper sheet feeder includes a separation conveying unit 32 and a sheet feed clutch 49, for example. The paper sheet detecting unit includes, for example, a bypass feed plate 40. Manual paper feed paths are indicated by arrows in the drawings.

The side surface cover 30 is turnably supported by a side surface of the main body of the image forming apparatus 100. The side surface cover 30 is selectively located at one of an open position and a close position. The open position is where the side surface cover 30 is opened at a predetermined angle from the side surface of the main body of the image forming apparatus 100. The close position is where the side surface cover 30 is housed in a housing unit 80 (see FIG. 1) formed at the side surface of the main body, and becomes a part of the main body. The paper sheet tray 31 (describe later) and the first auxiliary tray 37 individually slide with respect to a top surface of the side surface cover 30.

The paper sheet tray 31 is connected to the main body of the image forming apparatus 100 by a link member (not illustrated). Specifically, one end portion and the other end portion of the link member are rotatably connected to the paper sheet tray 31 and the main body side surface of the image forming apparatus 100, respectively, and an upstream-side end portion of the paper sheet tray 31 with respect to a paper feeding direction is engaged with a guide groove located at both ends in a width direction of the side surface cover 30. This causes the paper sheet tray 31 to be slidable with respect to the side surface cover 30. The paper sheet tray 31 accommodates a paper bundle, and a downstream-side end portion of the paper sheet tray 31 in a paper feeding direction is connected to an elevating plate 33. Additionally, a pair of the width adjustment guides 35, which is movable in a paper sheet width direction, is provided at the paper sheet tray 31. A paper sheet detecting sensor (not illustrated), which is installed on the bypass feed plate 40, detects a width of the paper sheet in the paper bundle stored on the paper sheet tray 31 and whether or not a paper sheet is on the paper sheet tray 31. A paper sheet longitudinal size sensor (not illustrated), which is located at the paper sheet tray 31, detects a longitudinal size of the paper bundle. A paper sheet width may be detected by a distance between the width adjustment guides 35.

At an upstream-side end portion of the paper sheet tray 31 in the paper feeding direction, the first auxiliary tray 37 and the second auxiliary tray 38 are provided. The first auxiliary tray 37 includes a boss portion (not illustrated) engaged with a guide rail (not illustrated) located at a top surface of the side surface cover 30. The first auxiliary tray 37 is slidable to the paper sheet tray 31 by a slide of a boss portion along a guide rail. Furthermore, at an upstream side of the guide rail in the paper feeding direction, an engaging hole (not illustrated), with which the boss portion can be engaged, is located. When the first auxiliary tray 37 is extracted to a position where the boss portion and the engaging hole are engaged, the first auxiliary tray 37 is secured to the paper sheet tray 31. Thus, the first auxiliary tray 37 is selectively located at a house position or the first support position. The house position is where the first auxiliary tray 37 is overlapped with the paper sheet tray 31. The first support position is where the first auxiliary tray 37 is extracted from the paper sheet tray 31 to support the paper bundle.

The second auxiliary tray 38 is slidably to the paper sheet tray 31 and the first auxiliary tray 37. The second auxiliary tray 38 is selectively located at a house position, a first support position, or a second support position. The house position is where the second auxiliary tray 38 is overlapped with the paper sheet tray 31. The first support position is where the second auxiliary tray 38 is extracted from the paper sheet tray 31 along with the first auxiliary tray 37 to support the paper bundle. The second support position is where the second auxiliary tray 38 is extracted from the first auxiliary tray 37 to support a large-size paper bundle. At the upstream-side end portion of the second auxiliary tray 38 in the paper feeding direction, an auxiliary plate 60 is turnably supported. FIG. 2 and FIG. 3 illustrate a state where the first auxiliary tray 37 and the second auxiliary tray 38 are located at the first support position.

The following describes an up and down operation of the elevating plate 33 in detail. The paper sheet tray 31 pivotally supports the elevating plate 33 at an end portion side separated from the separation conveying unit 32. A turn centered on this spindle causes the elevating plate 33 to be liftable. Unless from a cam 45 (describe later) and a cam actuator 47 provide the elevating plate 33 with an external force, the elevating plate 33 is in a state where the elevating plate 33 is moved down to an approximately identical position to a top surface of the paper sheet tray 31. In this state, the paper bundle to be on the paper sheet tray 31 is supplemented and exchanged.

On the other hand, at a turn end portion of the elevating plate 33, that is, near an end portion side that is close to the separation conveying unit 32, the cam 45, the cam actuator 47, and a compression spring (not illustrated) are located. The cam 45 is rotated by a solenoid 43. The cam actuator 47 is swung in a vertical direction by rotation of the cam 45. The compression spring (not illustrated) is located between the elevating plate 33 and the side surface cover 30, and biases the elevating plate 33 in an upward direction. The cam actuator 47 has a swing end located at a position where the elevating plate 33 can be depressed. When the cam 45 rotates in a predetermined direction by a predetermined amount, the cam actuator 47, which depresses the elevating plate 33, swings toward the upward direction by a predetermined amount, and the compression spring brings up a back surface of the elevating plate 33. Consequently, the elevating plate 33 is located in a state where the most upper paper sheet among the paper bundle is brought into pressure contact with a paper feed roller 32*a*.

Next, the following describes a paper feeding operation of the manual paper feeder 11. When a user inputs a manual paper feed instruction into the manual paper feeder 11, a control signal is transmitted from a control unit (not illustrated) in the image forming apparatus 100. This causes the sheet feed clutch 49 to operate to cause the paper feed roller 32*a* to start rotating. Then, at a predetermined time point, the solenoid 43 operates to cause the cam 45 to rotate by a predetermined amount. This releases a depressing force that has been acting on the elevating plate 33 via the cam actuator 47, the elevating plate 33 is pushed up by the biasing force of the compression spring, and the most upper paper sheet among the paper bundle is pushed against the paper feed roller 32*a*. This causes the paper feeding operation.

Then, at a nip area between the paper feed roller 32*a* and a separation pad 32*b*, only the most upper one paper sheet in contact with the paper feed roller 32*a* is separated, and conveyed to the paper sheet conveyance passage 16 (see FIG. 1) in the image forming apparatus 100.

An elevating plate position detection sensor 50 detects an operating state of the elevating plate 33, and transmits the detection result to the control unit. Specifically, a reflective plate (not illustrated) is attached on a side surface of the cam 45 such that a light, which is irradiated from a light source (not illustrated), is reflected by the reflective plate to enter the elevating plate position detection sensor 50 when the elevating plate 33 is moved up to near the paper feed roller 32*a*. At this time, the elevating plate position detection sensor 50 transmits a detection signal to the control unit, and the control unit recognizes that the elevating plate 33 is moved up.

On the other hand, when the elevating plate 33 is moved down to a top surface of the paper sheet tray 31, a position of the reflective plate is moved by rotation of the cam 45, and then a light reflected by the reflective plate enters the elevating plate position detection sensor 50. Thus, the elevating plate position detection sensor 50 does not transmit a detection signal, and the control unit recognizes that the elevating plate 33 has been moved down. As the elevating plate position detection sensor 50, various kinds of light sensors such as a photodiode, a phototransistor, a photo IC may be used. Here, the above has described one example of how to detect a position of the elevating plate 33. Another kind of sensors other than a light sensor may be used as the elevating plate position detection sensor 50.

Figure 4:
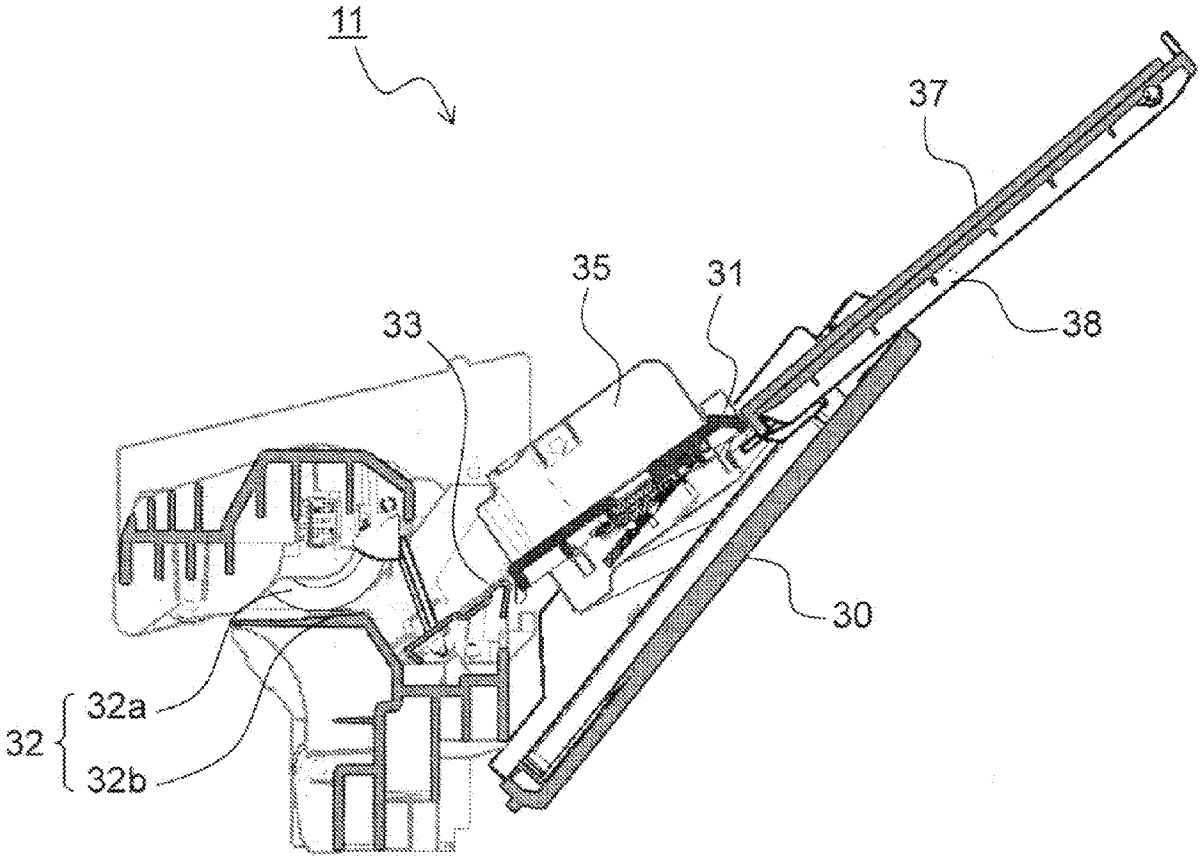
FIG. 4 illustrates a state in a side surface of a cross-sectional view where a first auxiliary tray and a second auxiliary tray are located at a first support position in the manual paper feeder according to the first embodiment.
Figure 5:
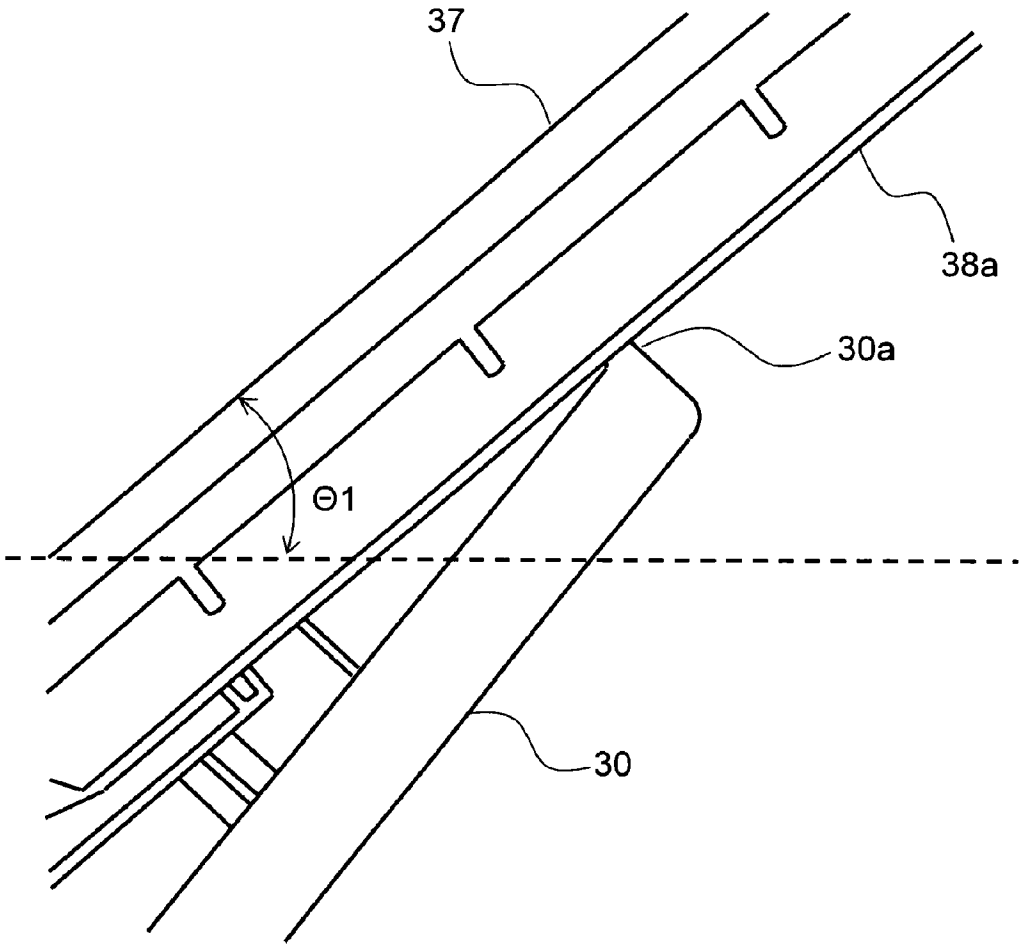
FIG. 5 illustrates an enlarged abutting portion around and between the second auxiliary tray and a side surface cover in FIG. 4.

FIG. 4 illustrates a state in a side surface of a cross-sectional view where the first auxiliary tray 37 and the second auxiliary tray 38 are located at the first support position in the manual paper feeder 11 of the embodiment. FIG. 5 illustrates an enlarged abutting portion around and between the second auxiliary tray 38 and the side surface cover 30 in FIG. 4.

When the manual paper feeder 11 feeds a paper sheet that has a small size (for example, A4 lateral size), as illustrated in FIG. 4, the first auxiliary tray 37 and the second auxiliary tray 38 are extracted from the paper sheet tray 31, and located at the first support position. In this state, the second auxiliary tray 38 is overlapped with a back surface (the side surface cover 30 side) of the first auxiliary tray 37, and as illustrated in FIG. 5, a distal end portion 30*a* of the side surface cover 30 is abutted on a back surface 38*a* of the second auxiliary tray 38.

Thus, the side surface cover 30 supports the first auxiliary tray 37 and the second auxiliary tray 38 at a predetermined angle θ1 that is an angle between the first auxiliary tray 37, which is a paper sheet loading surface, and a horizontal surface (illustrated by dashed lines in the drawings). The predetermined angle θ1 is one example of a first angle.

Figure 6:
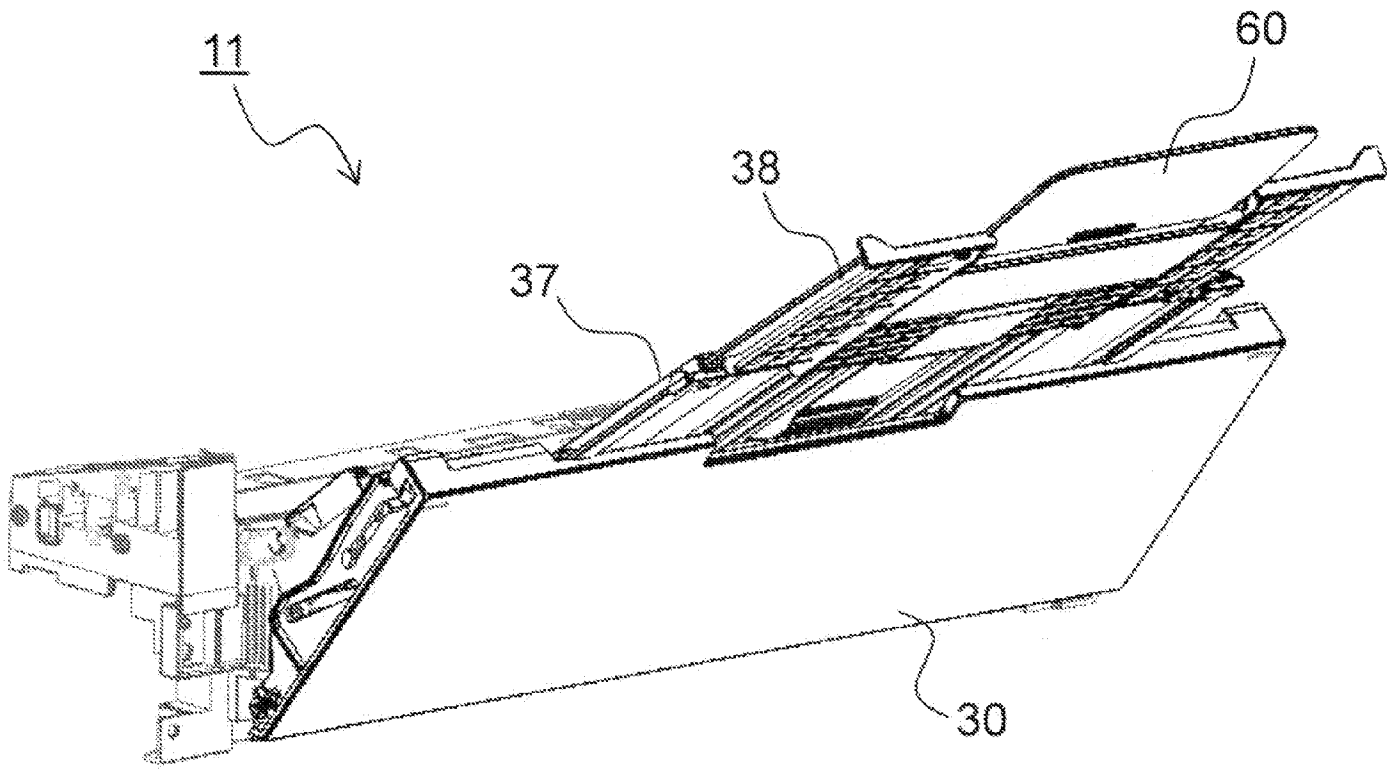
FIG. 6 obliquely illustrates a state where the second auxiliary tray is located at a second support position from a state illustrated in FIG. 4.
Figure 7:
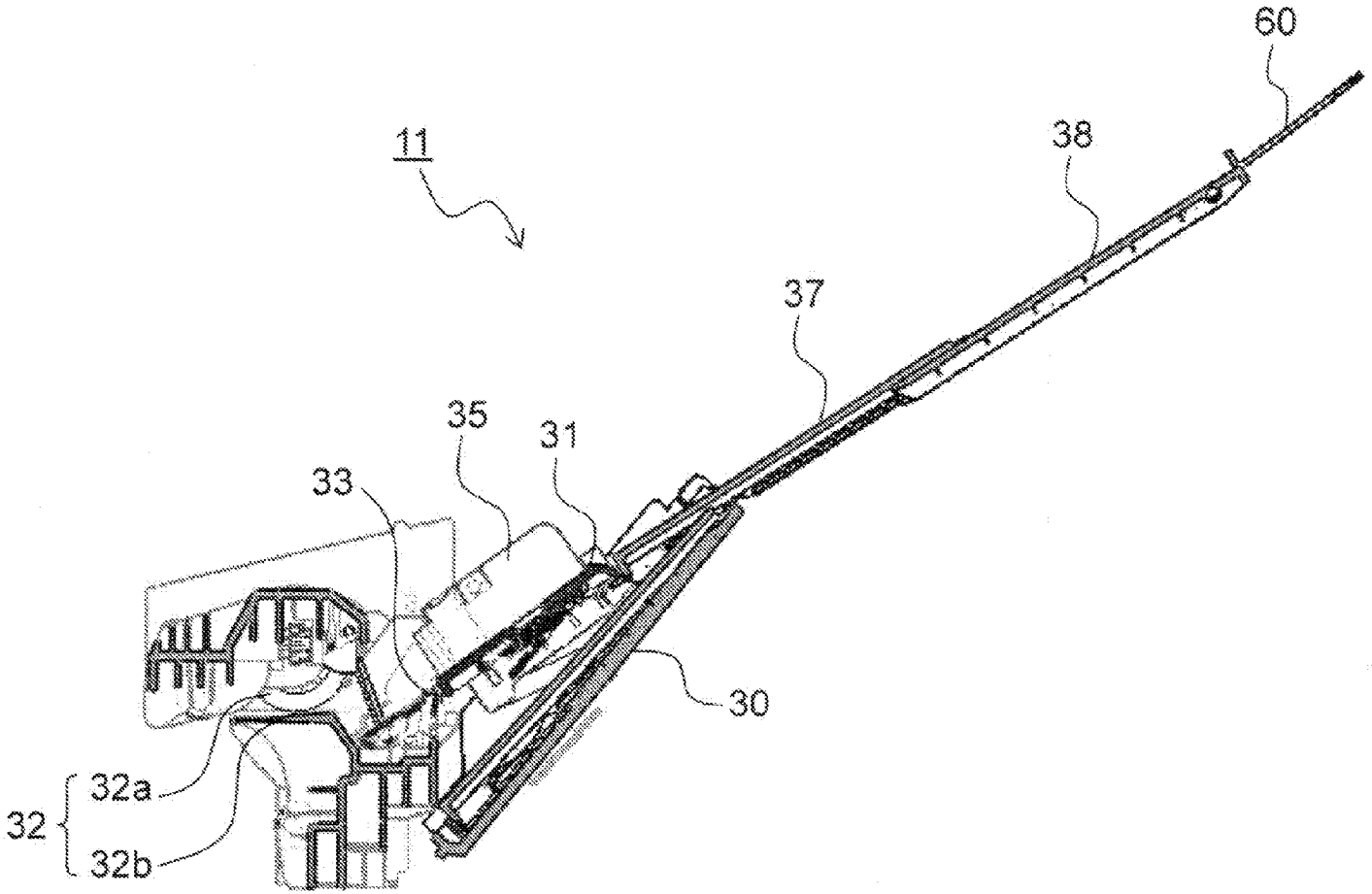
FIG. 7 illustrates a state in a side surface of a cross-sectional view where the second auxiliary tray is located at the second support position from the state illustrated in FIG. 4.
Figure 8:
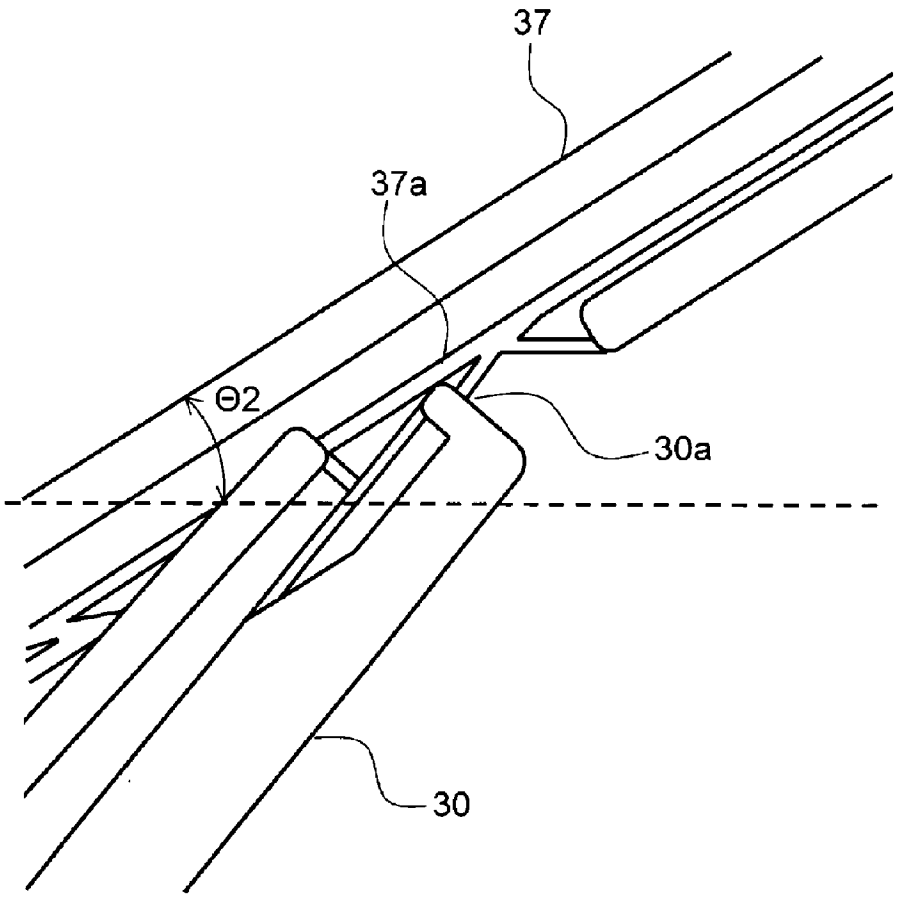
FIG. 8 illustrates an enlarged abutting portion around and between the first auxiliary tray and the side surface cover in FIG. 7.

FIG. 6 obliquely illustrates a state where in the manual paper feeder 11 of the embodiment, the second auxiliary tray 38 is located at a second support position from the state illustrated in FIG. 4. FIG. 7 illustrates a state in a side surface of a cross-sectional view where in the manual paper feeder 11 of the embodiment, the second auxiliary tray 38 is located at the second support position from the state illustrated in FIG. 4. FIG. 8 illustrates an enlarged abutting portion around and between the first auxiliary tray 37 and the side surface cover 30 in FIG. 7.

When the manual paper feeder 11 feeds a large-size paper sheet (for example, A3 size), as illustrated in FIG. 6 and FIG. 7, the second auxiliary tray 38 is extracted further from the state illustrated in FIG. 4, and located at the second support position. The auxiliary plate 60, which is housed to overlap with the second auxiliary tray 38, is folded back on an opposite side from the second auxiliary tray 38 (upstream side in a paper feeding direction). At this time, this causes the second auxiliary tray 38, which is located between the first auxiliary tray 37 and the side surface cover 30, to be extracted upward. Consequently, as illustrated in FIG. 8, the distal end portion 30*a* of the side surface cover 30 is abutted on a back surface 37*a* of the first auxiliary tray 37.

Thus, the side surface cover 30 supports the first auxiliary tray 37 and the second auxiliary tray 38 at a predetermined angle θ2, which is an angle between the first auxiliary tray 37, which is the paper sheet loading surface, and the horizontal surface (illustrated by dashed lines in the drawings). The opening angle of the side surface cover 30 is not varied in the state illustrated in FIG. 4 and a state illustrated in FIG. 7. Consequently, the abutting portion of the side surface cover 30 and the first auxiliary tray 37 illustrated in FIG. 7 is lower than the abutting portion of the side surface cover 30 and the second auxiliary tray 38 illustrated in FIG. 4. Thus, the angle θ2 becomes smaller than the angle θ1. The predetermined angle θ2 is one example of a second angle.

According to the embodiment, when a paper sheet that has a small size is loaded, an angle of the first auxiliary tray 37 with respect to the horizontal surface increases. This prevents a paper sheet from retreating when a paper sheet with a lightweight and a small size is sent into a paper sheet feeder, thus ensuring reduction of non-feed of a paper sheet.

When a paper sheet with a large size is loaded, an angle of the first auxiliary tray 37 with respect to the horizontal surface decreases. This prevents a plurality of heavy paper sheets with a large size from being sent into the paper feed roller 32*a* at one time, thus ensuring reduction of multi feeding of paper sheets. That is, regardless of paper sheet size, this ensures a stable paper feeding operation without non-feeding and multi feeding.

The above has described the manual paper feeder 11 that includes the first auxiliary tray 37, the second auxiliary tray 38, and the paper sheet tray 31 that is extendable in two phases. However, the disclosure is similarly applicable to a manual paper feeder that includes three or more auxiliary trays, and is extendable in three phases or more.

Figure 9:
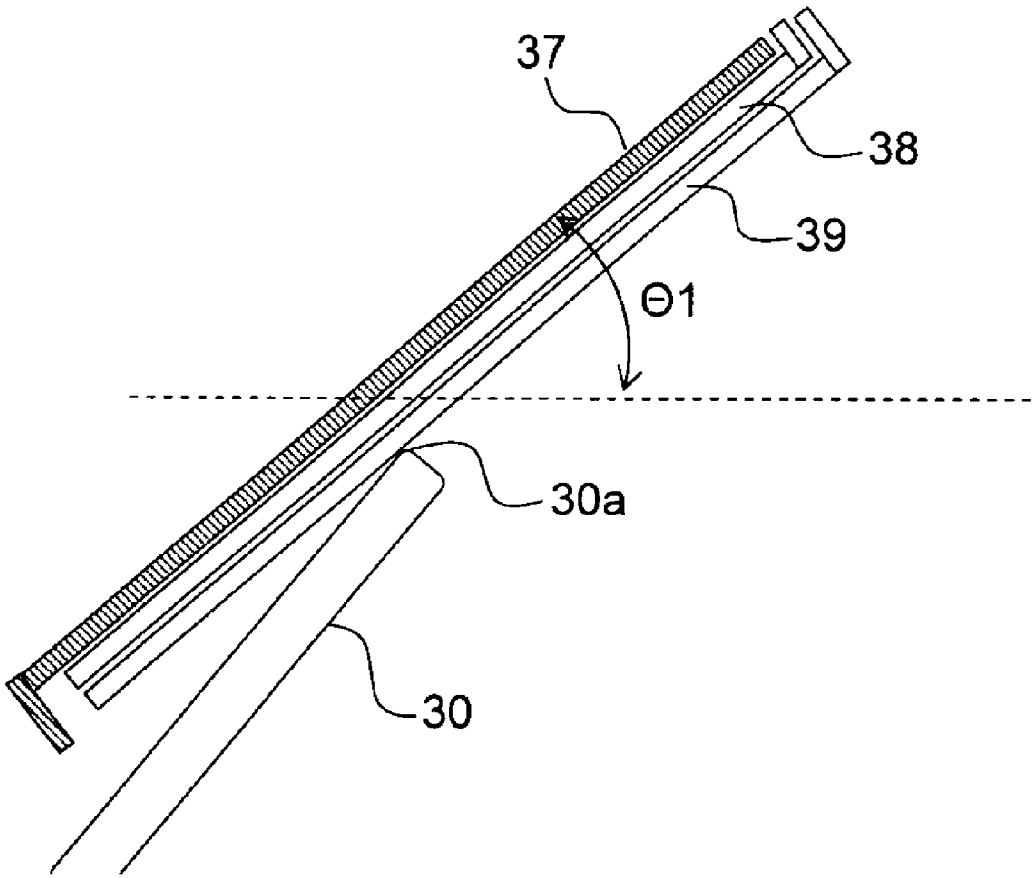
FIG. 9 illustrates around an enlarged abutting portion of the side surface cover at the time when the first auxiliary tray, the second auxiliary tray, and a third auxiliary tray are located at the first support position in the manual paper feeder, which includes the first auxiliary tray, the second auxiliary tray, and the third auxiliary tray, according to the second embodiment of the disclosure.

The manual paper feeder 11 according to the second embodiment of the disclosure includes three auxiliary trays of the first auxiliary tray 37, the second auxiliary tray 38, and a third auxiliary tray 39. FIG. 9 illustrates around an enlarged abutting portion of the side surface cover 30 at the time when the first auxiliary tray 37, the second auxiliary tray 38, and the third auxiliary tray 39 are located at the first support position. When a paper sheet with a small size (for example, B5 size) is loaded on the manual paper feeder 11 of the embodiment, as illustrated in FIG. 9, the first auxiliary tray 37, the second auxiliary tray 38, and the third auxiliary tray 39 are located at the first support position. At the time, the distal end portion 30*a* of the side surface cover 30 is abutted on the third auxiliary tray 39, and is supported at a predetermined angle θ1 that is an angle between the first auxiliary tray 37, which is the paper sheet loading surface, and the horizontal surface (illustrated by dashed lines in the drawings).

Figure 10:
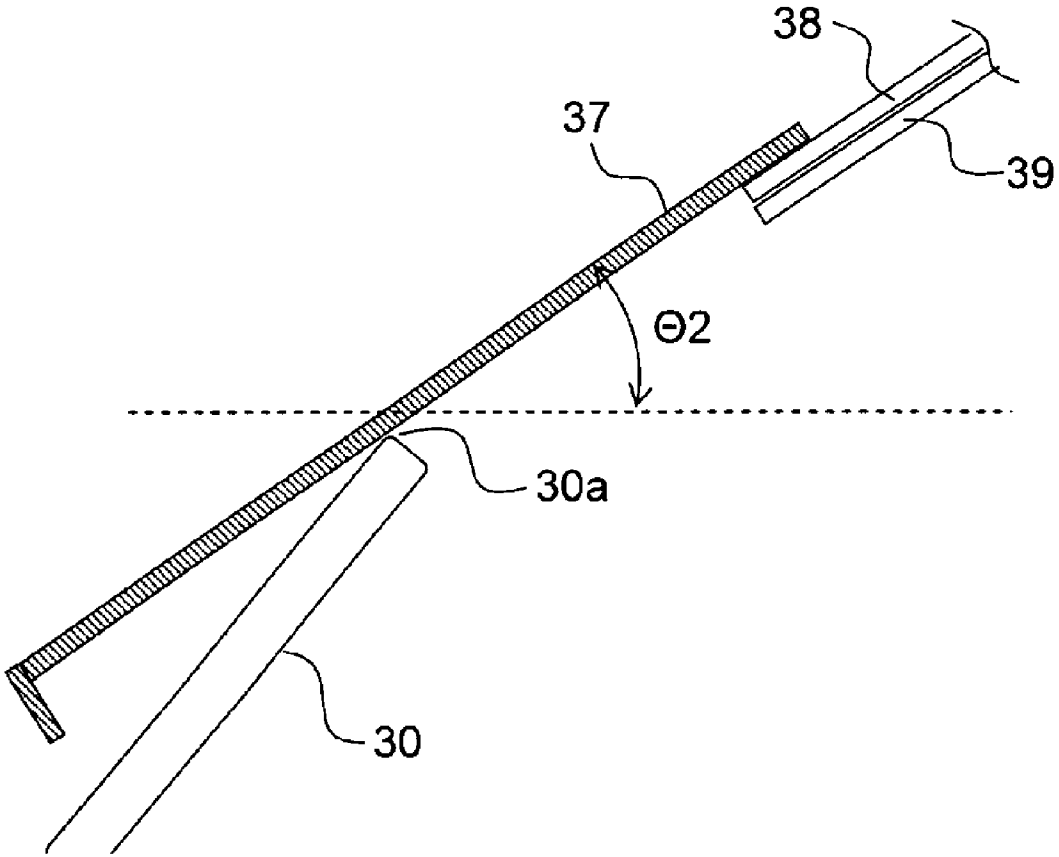
FIG. 10 illustrates around an enlarged abutting portion of the side surface cover at the time when the second auxiliary tray and the third auxiliary tray are located at the second support position from a state illustrated in FIG. 9.

When a paper sheet with a middle size (for example, A4 size) is loaded on the manual paper feeder 11 of the embodiment, as illustrated in FIG. 10, the second auxiliary tray 38 and the third auxiliary tray 39 are extracted further from the state illustrated in FIG. 9, and then are located at the second support position. At the time, the distal end portion 30*a* of the side surface cover 30 is abutted on the first auxiliary tray 37, and is supported at a predetermined angle θ2 that is an angle between the first auxiliary tray 37, which is the paper sheet loading surface, and the horizontal surface (illustrated by dashed lines in the drawings). The abutting portion of the distal end portion 30*a* of the side surface cover 30 and the first auxiliary tray 37 is lower than the abutting portion of the distal end portion 30*a* of the side surface cover 30 and the third auxiliary tray 39 illustrated in FIG. 9. Thus, the angle θ2 becomes smaller than the angle the θ1.

When a large-size (for example, A3 size) paper sheet is loaded on the manual paper feeder 11 of the embodiment, the third auxiliary tray 39 is extracted further from the state illustrated in FIG. 10, and then is located at a third support position. At this time, the distal end portion 30*a* of the side surface cover 30 is abutted on the first auxiliary tray 37, and the angle between the first auxiliary tray 37, which is the paper sheet loading surface, and the horizontal surface (illustrated by dashed lines in the drawings) is maintained at θ2 as illustrated in FIG. 10.

Consequently, similarly to the first embodiment, when a paper sheet with a lightweight and a small size is sent into the paper sheet feeder, a retreat of a paper sheet is reduced. This ensures reduction of non-feed of a paper sheet. Additionally, this reduces an occurrence of a phenomenon where a plurality of heavy paper sheets with a large size are sent into the paper feed roller 32*a* at one time. This ensures reduction of multi feeding of paper sheets.

The disclosure is not limited to the above-described embodiments and can be variously modified without departing from the spirit of the disclosure. While in the above-described embodiment, the paper feed roller 32*a* and the separation pad 32*b* constitute the separation conveying unit 32, for example, a retard roller with a torque limiter may be located instead of the separation pad.

The disclosure is not limited to a monochrome printer illustrated in FIG. 1, and obviously applicable to another type of image forming apparatus such as a color printer, a monochrome and color copier, a digital multi-functional peripheral, and a facsimile device that include a manual paper feeder.

The disclosure is applicable to a manual paper feeder that feeds a sheet-shaped recording medium. Use of the disclosure ensures a provision of a manual paper feeder that ensures stable feed regardless of size of recording medium, and has a simple configuration and an image forming apparatus that includes the manual paper feeder.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A manual paper feeder installed at a side surface of a main body of an image forming apparatus, comprising:

a side surface cover that is turnably supported by the side surface of the main body and selectively located at one of an open position and a close position, the open position being where the side surface cover is opened by a predetermined angle from the side surface of the main body, the close position being where the side surface cover is housed in a recess portion formed at the side surface of the main body;

a sheet loading tray that is located at a top surface of the side surface cover and capable of loading a sheet when the side surface cover is located at the open position;

a separation conveying unit including a feed member and a separation member, the feed member being located at a downstream side of the sheet loading tray in a feed direction for sending out a sheet to a feed direction, the separation member being located facing the feed member, the separation conveying unit separately conveying only one sheet at a most upper side of sheets loaded on the sheet loading tray;

an elevating plate located at the downstream side of the sheet loading tray in the feed direction so as to cause a downstream portion of the sheet to abut on the feed member; and a first auxiliary tray and a second auxiliary tray slidably disposed so as to overlap one another in a sheet loading direction at an upstream side of the sheet loading tray in the feed direction, the first auxiliary tray being selectively located at a house position where the first auxiliary tray is housed so as to be overlapped between the side surface cover and the sheet loading tray or an extension position where the first auxiliary tray is extracted from the house position so as to extend a loading surface of the sheet loading tray, the second auxiliary tray extending the first auxiliary tray; wherein when the first auxiliary tray is located at the extension position in a state where the second auxiliary tray is housed downwards, an abutment between an upstream side end edge of the side surface cover and an inferior surface of the second auxiliary tray supports the first auxiliary tray at a first angle, and when the second auxiliary tray is extracted from the first auxiliary tray at the extension position, an abutment between the upstream side end edge of the side surface cover and the inferior surface of the first auxiliary tray supports the first auxiliary tray at a second angle, the second angle being smaller than the first angle.

2. The manual paper feeder according to claim 1, further comprising:

a third auxiliary tray that extends the second auxiliary tray, the third auxiliary tray being slidably disposed to overlap with the second auxiliary tray in the sheet loading direction; wherein the third auxiliary tray is extracted from the first auxiliary tray together with the second auxiliary tray at the extension position, the abutment between the upstream side end edge of the side surface cover and the inferior surface of the first auxiliary tray supporting the first auxiliary tray at the second angle.

3. An image forming apparatus comprising the manual paper feeder according to claim 1.

* * * * *